United States Patent [19]

Focke et al.

[11] 4,294,353

[45] Oct. 13, 1981

[54] SIDE CONNECTED CIGARETTE HALF-PACKS

[75] Inventors: Heinz H. Focke; Kurt Liedtke, both of Verden, Fed. Rep. of Germany

[73] Assignee: Focke & Co., Verden, Fed. Rep. of Germany

[21] Appl. No.: 112,491

[22] Filed: Jan. 16, 1980

[30] Foreign Application Priority Data

Jan. 24, 1979 [DE] Fed. Rep. of Germany ... 7901873[U]

[51] Int. Cl.[3] ..... B65D 85/10

[52] U.S. Cl. ..... 206/273; 206/602; 206/631; 229/27; 229/44 CB

[58] Field of Search ..... 206/273, 249, 271, 602, 206/631; 229/27, 44 CB

[56] References Cited

U.S. PATENT DOCUMENTS

| | | | |
|---|---|---|---|
| 2,959,338 | 11/1960 | Thurston | 206/631 |
| 3,135,457 | 6/1964 | Risucci | 229/27 |
| 3,160,342 | 12/1964 | Murdock et al. | 206/249 |
| 3,341,103 | 9/1967 | May | 229/27 |

*Primary Examiner*—William T. Dixson, Jr.
*Attorney, Agent, or Firm*—Sughrue, Mion, Zinn, Macpeak and Seas

[57] ABSTRACT

A cigarette pack consisting of two dimensionally identical half-packs 2, 4 which can be folded one onto the other and which are connected along a V-shaped fold 14 by a separating line 22. Each half-pack has a lid 18, 18' which in the closed position is held behind the front wall 10, 10' of said half-pack. The pack is made from a one piece blank which can be laid out on a sheet or web of packaging material and stamped therefrom without waste.

8 Claims, 2 Drawing Figures

SIDE CONNECTED CIGARETTE HALF-PACKS

BACKGROUND OF THE INVENTION

This invention relates to a cigarette pack consisting of identical partial packs which can be folded onto each other and connected by a separating line, and to blanks from which such packs are formed.

German Utility Model No. 7,419,126 discloses a cigarette pack made from three individual blanks. Two rectangular sleeves which can be folded onto each other and are connected with each other by a separating line are made from the first blank. A separate insert or slide made from separate blanks can be pushed into each sleeve and serves to receive cigarettes.

The manufacture of a finished pack according to German Utility Model No. 7,419,126 is relatively expensive both with regard to time and material expense, and additional time is necessary to slide the inserts into the sleeves.

SUMMARY OF THE INVENTION

The pack according to the invention consists of a one-piece blank, wherein each partial pack includes a back wall having a lid flap attached by means of a fold line for closing it and a front wall connected with the back wall by a floor wall, and wherein the back walls are connected with each other by a V-shaped folded central panel.

The invention thus allows the manufacture of a relatively complicated double pack from a single blank, and the blanks can be made from a web or sheet of material without any waste.

Preferably, after folding the side walls extending parallel to the central panel as well as folding the back walls and front walls, the article to be packaged, for example cigarettes wrapped in a tinfoil block, is brought into position so that it is fixed in place by the folded side walls and central panel. Thereafter the lid flap is folded, and because it is larger than the cutout of the front wall, it is inserted behind the front wall in the interior of the package.

The two front walls are then folded onto the packaged articles, and the side walls extending parallel to the central panel and associated with the front and back walls folded over one onto the other, are glued together or to the adjacent sides of the V-shaped central panel.

DETAILED DESCRIPTION OF THE PREFERRED EMBODIMENT

Figure 1:
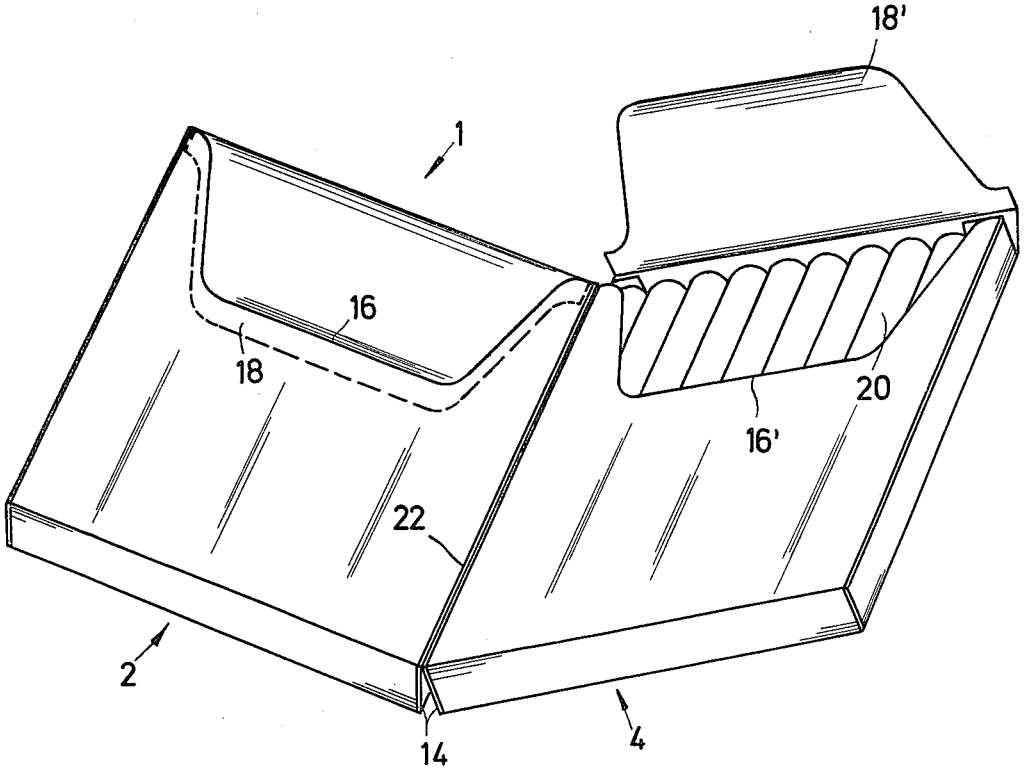
FIG. 1 is a perspective illustration of a pack according to the invention.
Figure 2:
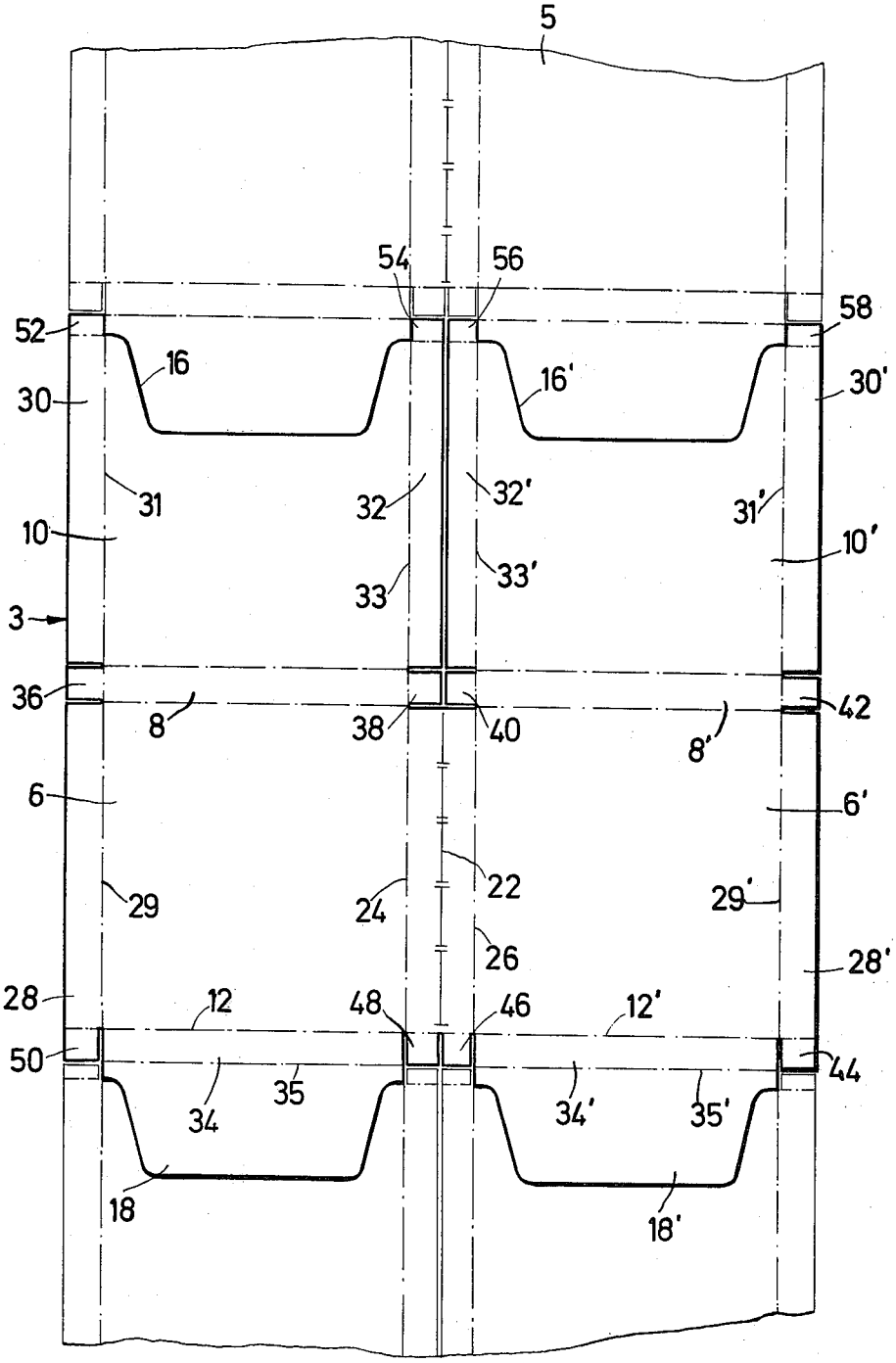
FIG. 2 is a material web on which a blank for the pack according to FIG. 1 is accentuated with darker lines.

FIG. 1 illustrates a pack 1 produced from a one-piece blank 3 according to FIG. 2, said pack having two basically identical foldable partial packs 2 and 4 connected with each other by a separating line 22. The partial packs 2 and 4 are each formed as flat rectangles and serve to receive cigarettes 20; they each have a cutout 16, 16' to facilitate the removal of the cigarettes. The cutouts are closed by cover flaps 18, 18'. As clearly shown in FIG. 1, the cutouts have approximately the same shape as the cover flaps, but are somewhat smaller than said cover flaps in the folded packs. In this manner the cover flaps remain in the closed position when they are pushed behind the cutouts and into the interior of the partial packs 2, 4. The cover flap 18 in the partial pack 2 is shown in the closed condition, while cover flap 18' in the partial pack 4 is shown in the open position. The two partial packs are connected with each other by a V-shaped foldable central panel 14. The manner in which this central panel is formed will be described in greater detail below.

Reference numeral 5 in FIG. 2 designates a web of material. One-piece blanks 3 for the manufacture of the pack according to FIG. 1 are stamped out of this web. The stamp or cut lines are shown with solid lines; the fold lines and the separating line 22 are shown by broken lines.

The blank shown in FIG. 2 consists of two adjacent back walls 6, 6' and front walls 10, 10' lying laterally to the longitudinal direction of the web. The two back walls are not separated from each other during stamping. The front walls 10, 10' are connected with their associated back walls 6, 6' by floor walls 8, 8'. Three fold lines 22, 24, 26 extending parallel to the longitudinal direction of the web are formed between the back walls, whereby the center fold line 22 is what would later be the separating line between the two partial packs 2, 4. A cover flap 18, 18' is joined to each of the back walls 6, 6' by a fold line 12, 12'. Cutouts 16, 16' are provided accordingly on the front walls 10, 10'. The contour lines of the cutouts 16, 16' basically correspond to the contour lines of the cover flaps 18, 18'. The cutout areas, however, are somewhat smaller than the cover flaps when the packages are folded. Because of this, the cover flaps can be pushed beneath the front walls in the finished partial packs 2, 4 and are thereby securely held in the closed position. An additional closure strip for closing the partial packs is thus avoided.

Side walls 28, 28' and 30, 32, 30', 32' are connected to the back walls and front walls 6, 6' and 10, 10' by fold lines 29, 29' and 31, 31', 33, 33' extending parallel to the longitudinal direction of the web. The width of the side walls defines the thickness of the partial packs 2, 4. The cover flaps 18, 18' include respective further fold lines 35, 35', which extend parallel to the fold lines 12, 12' and are spaced therefrom. The space therebetween corresponds to the width of the side walls. The two fold lines 12, 35 or 12', 35' define the respective tops 34, 34' of the two partial packs.

The side walls 28, 28', 8, 8' and 30, 30' each include connecting flaps 36, 38, 40, 42, 44, 50, 52, 54, 56 and 58, which are disposed at various positions along the side walls and are connected thereto by fold lines.

The V-shaped central panel 14 between the two partial packs is formed by the section defined by the fold lines 22, 24, 26. Connecting flaps 46, 48 are joined to this section by extensions of the fold lines 12, 12'.

After stamping of the one-piece blank 3 and the imprinting of the fold lines, the three fold lines 22, 24, 26 extending parallel to the longitudinal direction of the web and which are spaced from each other according to the width of the side walls, are folded between the two adjacent back walls to form a V-shaped central panel 14. The folding takes place by pushing the two back walls 6, 6' toward each other, and proceeds in such a manner that the point of the V formed by the separating line 22 points upward.

After forming the central panel 14, the side walls 28, 28', 30, 30', 32, 32' extending parallel to the central panel 14, and the front walls and back walls of the blank are folded, as are the cover flaps 18, 18' and the connecting flaps 36, 38, 40, 42, 44, 46, 48, 50, 52, 54, 56 and 58. The folding of all side walls and connecting flaps takes place in the same direction as the folding of the central panel 14. Thus in the present example the side walls 28, 28', 30, 30', 32, 32' and the lid 34, 34' and all connecting flaps are folded out of the web plane and vertically upward. The cigarrettes are then positioned on the back walls 6, 6' so that they extend parallel to the longitudinal direction of the web. They are held in position by the folded side walls 28, 28', 34, 34' and by the folded central panel 14.

Subsequently the lid flaps 18, 18' are folded about lines 35, 35' parallel to the back walls. The front and back walls of the blank 3 are then folded one onto the other to form the two partial packs 2, 4, wherein the side walls 28, 28' of the back walls 6, 6' are glued to the side walls 30, 30' of the front walls 10, 10', and the side walls 32, 32' of the front walls are glued to the sides of the V-shaped central panel 14. The connecting flaps 36, 42 are also glued to the side walls 28, 30 or 28', 30'. The connecting flaps 38, 40 are glued to the side walls 32, 32' while the connecting flaps 44, 46, 48, and 50 joined to the back walls 6, 6' are glued to the connecting flaps 58, 56, 54, 52 joined to the front walls 10, 10'. The above-described process provides a stable pack consisting of two partial packs 2, 4 connected with each other by means of the V-shaped central panel 14. In the closed condition the V-shaped central panel forms a level side surface.

As clearly shown in FIG. 2, the blanks 3 can be produced from a web 5 without any waste.

If a pack as shown in FIG. 1 is to protect cigarettes, the width of the side walls is approximately the same as or slightly more than the outside diameter of a cigarette.

The connecting flaps 44, 46, 48, 50, 52, 54, 56 and 58 are not absolutely necessary. On the other hand, in the finished partial packs they form advantageous limiting elements against sliding the cover flaps 18, 18' too far into the interior of the partial packs 2, 4. Connecting flaps 44 through 58 thus prevent the cover flaps 18, 18' from being pushed too far in, independently of whether the partial packs are completely or only partially filled. The connecting flaps 44 through 58 also serve to increase the rigidity of the partial packs.

If the separating line 22 is formed as an intended break point, for example as a perforated line, one partial pack, when empty, can easily be separated from the still full partial pack.

What is claimed is:

1. A pack for enclosing a pair of cigarette groups, comprising two partial packs connected together via a fold line and made from a one-piece blank, each said partial pack being provided with a rear wall having a closing flap attached thereto by means of an intermediate cover wall, and a front wall having a cut-out portion adapted for the insertion of said closing flap therebehind, wherein said rear wall and said frontal wall of each partial package are connected to one another by a bottom wall, said frontal walls facing one another when said pack is folded so as to be closed, and wherein said fold line defines a center line of a center bridge extending between said partial packs, said center bridge, when folded along said fold line, extending between the planes of said rear walls and said frontal walls.

2. A pack as claimed in claim 1, wherein the area of said cut-out portion (16,16') in the frontal wall (10, 10') is smaller than the area of the closing flap (18,18'), in such a manner that the closing flap, in its closed position, is pushed underneath a rim area formed by the frontal wall (10,10') along the cut-out (16,16').

3. A pack as claimed in claim 1, wherein said center bridge (14) is folded in a V-shape between the opened partial packages (2,4).

4. A pack as claimed in claim 1, wherein the folding line (22) is perforated so as to form a separating line.

5. A pack as claimed in claim 1, wherein the free edge of the closing flap (18,18') and the edge of the cut-out (16,16') have the same contours, and wherein the closing flap (18,18') has a larger surface area than the cut-out (16,16') due to an extension thereof which faces said cover wall (34,34').

6. A pack as claimed in claim 1, wherein side walls of the partial packs (2,4) each consist of superimposed lateral wall portions (28,28'; 30,30'; 32,32') and connecting flaps (44, 46, 48, 50; 52, 54, 56, 58) arranged at the end of the lateral wall portions facing the cover flap (18,18'), which are connected with each other and folded towards the inside of the partial packs.

7. A pack according to claim 1, wherein said one-piece blank comprises:

an essentially rectangular layout, said frontal walls (10,10') and said rear walls (6,6') of the partial packages (2,4) being arranged adjacent to each other relative to the longitudinal extension of a sheet of material (5) from which said blank is cut, said frontal walls (10,10') of the neighboring partial packages being separated from each other by punch-out, and said rear walls (6,6') being connected to each other by said center bridge (14), said blank being severed from said sheet by a punching cut running at right angles with respect to the longitudinal direction of said sheet, and having the contours of the closing flap (18,18').

8. A pack as claimed in claim 7, wherein said closing flaps (18,18') have an extension at their side facing the cover wall (34,34'), and lateral wall portions (30,30'; 32,32') of said pack have a connecting flap (52, 54, 56, 58) of a height equal to the width of said extension.

* * * * *